US010745250B2

(12) United States Patent
Nevsimal-Weidenhoffer

(10) Patent No.: US 10,745,250 B2
(45) Date of Patent: Aug. 18, 2020

(54) STS MULTI-TROLLEY PORTAL GANTRY CONTAINER CRANE

(71) Applicant: Vladimir Nevsimal-Weidenhoffer, Creteil (FR)

(72) Inventor: Vladimir Nevsimal-Weidenhoffer, Creteil (FR)

( * ) Notice: Subject to any disclaimer, the term of this patent is extended or adjusted under 35 U.S.C. 154(b) by 0 days.

(21) Appl. No.: 15/769,061

(22) PCT Filed: Oct. 27, 2015

(86) PCT No.: PCT/EP2015/074849
§ 371 (c)(1),
(2) Date: Apr. 17, 2018

(87) PCT Pub. No.: WO2017/071736
PCT Pub. Date: May 4, 2017

(65) Prior Publication Data
US 2018/0312375 A1 Nov. 1, 2018

(51) Int. Cl.
*B66C 19/00* (2006.01)
*B66C 5/02* (2006.01)
*B66C 13/18* (2006.01)

(52) U.S. Cl.
CPC ..... *B66C 19/002* (2013.01); *B66C 5/02* (2013.01); *B66C 13/18* (2013.01); *B66C 19/00* (2013.01); *B66C 2700/01* (2013.01); *B66C 2700/0328* (2013.01)

(58) Field of Classification Search
CPC ..... B66C 19/00; B66C 19/002; B66C 19/005; B66C 19/007; B66C 19/02
See application file for complete search history.

(56) References Cited

U.S. PATENT DOCUMENTS 4,139,180 A 2/1979 Itani et al.
4,358,020 A * 11/1982 Thiele ..... B66C 19/007 105/163.2
5,456,560 A * 10/1995 Rudolf, III ..... B65G 67/603 414/139.7
5,603,598 A * 2/1997 Hasegawa ..... B66C 19/002 414/140.3
6,601,717 B1 * 8/2003 Khachaturian ..... B66C 19/02 212/270
2002/0197135 A1 12/2002 Arntzen et al.
(Continued)

FOREIGN PATENT DOCUMENTS

CN 204324739 U 5/2015
CN 204342298 U 5/2015
(Continued)

OTHER PUBLICATIONS

Jordan, Michael A. "Super Productive Cranes," Liftech, 1997, pp. 1-11.
(Continued)

*Primary Examiner* — Michael R Mansen
*Assistant Examiner* — Juan J Campos, Jr.
(74) *Attorney, Agent, or Firm* — Oliff PLC

(57) ABSTRACT

A portal gantry crane including: two parallel main girders running side by side on respective sides of a midplane, two legs each positioned in the midplane, two couples of trolleys, each couple of trolleys operating on a corresponding girder, each trolley carrying a hoist.

17 Claims, 3 Drawing Sheets

(56) References Cited

U.S. PATENT DOCUMENTS

| | | | | |
|---|---|---|---|---|
| 2003/0106870 | A1* | 6/2003 | Takehara | B65G 63/004 212/312 |
| 2003/0108405 | A1 | 6/2003 | Takehara et al. | |
| 2006/0182526 | A1 | 8/2006 | Weis | |
| 2011/0240584 | A1* | 10/2011 | Franzen | B66C 13/08 212/324 |
| 2013/0001183 | A1* | 1/2013 | Wierzba | B66C 11/04 212/316 |

FOREIGN PATENT DOCUMENTS

| | | | |
|---|---|---|---|
| DE | 29 11 938 | A1 | 10/1980 |
| DE | 34 32 284 | A1 | 3/1986 |
| DE | 43 07 254 | A1 | 9/1994 |
| EP | 0 167 235 | A1 | 1/1986 |
| EP | 2 743 217 | A1 | 6/2014 |
| FR | 2 929 258 | A1 | 10/2009 |
| JP | S60-159789 | U | 10/1985 |
| JP | 62-050190 | U | 3/1987 |
| JP | 2003-246584 | | 9/2003 |
| JP | 2007-269425 | A | 10/2007 |
| JP | 2008-156015 | A | 7/2008 |
| JP | 2011-515301 | A | 5/2011 |
| WO | 93/01969 | A1 | 2/1993 |
| WO | 00/48 937 | A1 | 8/2000 |

OTHER PUBLICATIONS

Rankine, Gordon, "Container Ship Docking," Ports and Terminals Group, Feb. 2001.

Jul. 25, 2016 International Search Report issued in International Patent Application No. PCT/EP2015/074849.

Mar. 27, 2019 Office Action issued in Chinese Patent Application No. 2015800841921.

Jul. 1, 2019 Office Action issued in Japanese Application No. 2018-541485.

* cited by examiner

STS MULTI-TROLLEY PORTAL GANTRY CONTAINER CRANE

The present invention relates to a portal gantry crane for loading/unloading containers from a ship.

Container cranes are widely used worldwide to load/unload container vessels in container terminals.

To have the terminal function in an economically optimal way, it is essential that the cranes have a high degree of utilization.

In conventional container terminals, vessels are docked along the quay and conventional Ship-to-Shore (STS) container cranes are used to load/unload the vessels from one side.

Figure 2:
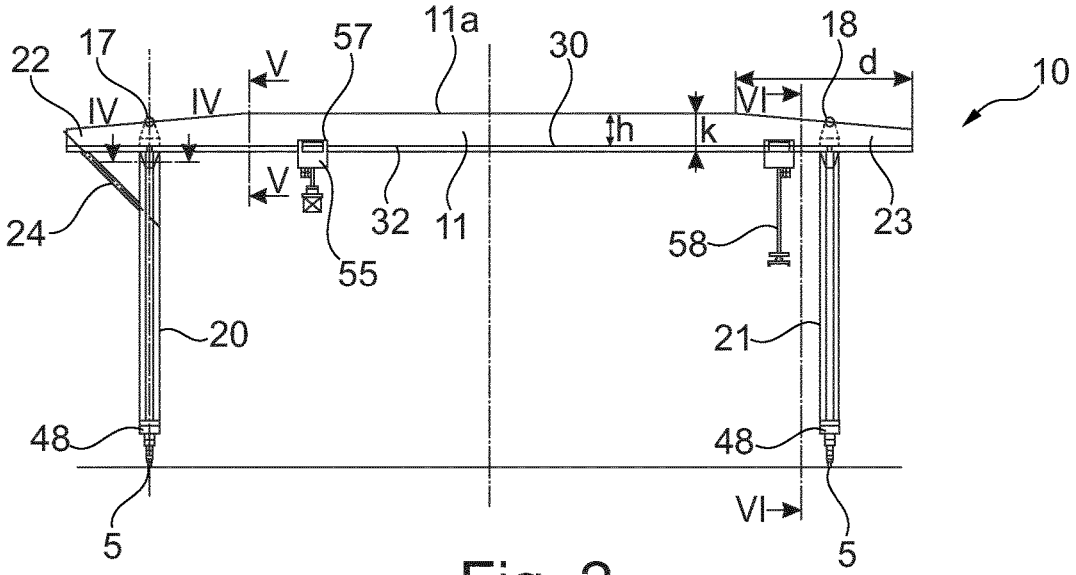

A conventional quay crane is depicted on FIG. 2 of US 2003/0108405 A1.

Such crane typically comprises a superstructure balanced by a counterweight traveling on two parallel tracks along the berth. A beam extends in cantilever fashion above the quay line and rear of the superstructure. Ties connect the main beam to the pinnacle of the superstructure. Such conventional cranes are also referred to as Panamax, Post-Panamax and Super-post-Panamax cranes.

These cranes do not allow to load/unload vessels as fast as desirable due to time of the trolley traveling on the beam. With these cranes the trolley has to travel across the entire width of the ship to handle the containers farthest to the quay.

To keep travel time as low as possible, the trolley is operated at a high speed, which results in high noise, and wear, this resulting in increased frequency and cost of maintenance.

The trolley is towed by relatively long ropes which, together with the long hoist ropes increase undesirable sway due to their length and elasticity.

These cranes also have the drawback of having a relatively poor aerodynamic performance which limits the capacity to operate in high winds.

The entire weight of the crane is supported by the quay in an unequal way as a result of cantilever which necessitates costly foundation works.

Since many years, the trend of construction of container ships makes them continually to grow and Ultra Large Container Vessels (ULCVs) have been built that are capable of carrying an increasing number of containers, currently exceeding 13,000 TEU and up to 20,000 TEU. It is important that these very expensive ships stay as short as possible in port for loading/unloading operations.

To ease loading/unloading operations, the use of double-sided berths such as indented berth has been proposed a long time ago.

The 1997 Liftech publication «Super Productive Cranes» explores various changes that could be brought to container terminals, such as double trolley cranes, but points out that one difficulty with two trolleys is load control and control of micro motions. For example, if one trolley needs to move in the gantry direction, the other trolley should not be disturbed.

This publication also discloses that an indented berth allows to operate the loading/unloading operations simultaneously from opposite sides of the berth. It gives the example of an indented berth having four cranes on each opposite quay, but points out that the overlapping booms may cause an interference problem which seriously complicates the operation of the container terminal.

At last, the publication contemplates using a bridge crane with two trolleys but concludes this would not be better for various reasons.

A similar proposal was made at the Ports and Terminal Conference in February 2001 by Beckett Rankine, which only discloses schematically two trolleys portal cranes spanning across docks to service large container vessels.

EP 2 743 217 A1 discloses a loading and unloading system for containers at quay side comprising a container crane having a mid-section supported on vertical columns allowing elevation for ship clearance and having a pair of lifting means for lifting containers from the ship. The crane comprises four pairs of legs for stability and is quite expensive and cumbersome.

US 2006/0182526 A1 discloses a multiple trolley container crane having at least two trolley tracks disposed one on top of the other, on which trolleys having running wheels, drive devices and lifting devices move. The crane may comprise a plurality of trolleys disposed one behind the other on each track.

Other multiple trolley cranes are disclosed in DE 43 07 254 A1, EP 0 167 235 A1 and WO 00/48 937.

There thus exists a need for advanced cranes allowing to reduce the time-in-port of modern container vessels, especially the ULCVs.

The invention aims at satisfying this need thanks to a novel portal gantry crane.

This portal gantry crane is characterized by the fact that it comprises:

Two parallel main girders running side by side, two couples of trolleys, each couple operating on a corresponding girder, each trolley carrying a hoist.

The crane according to the invention offers many advantages over existing container cranes and allows to improve significantly the productivity of a container terminal at a reasonable cost.

In preferred embodiments, the two parallel main girders run side by side on respective sides of a midplane, and the portal gantry crane comprises two legs each positioned in said midplane.

The portal gantry crane according to the invention is advantageously used in a container terminal comprising a double-sided berth such as an indented berth, the girders spanning across the berth.

The trolleys used to carry the containers can be operated independently of each other to load/unload a container vessel received in the berth.

The invention provides the ability of loading/unloading from both sides of the ship, and increases dramatically the loading/unloading rates, hence productivity, thus decreasing the in-port time of the ship. The trolleys of the crane are able to operate simultaneously in two bays of the vessel.

A further advantage is the reduction of the number of cranes per ship compared to infrastructures using conventional STS cranes. Accordingly, the initial investment for the cranes may be reduced.

Maintenance costs may also be reduced because of the lower number of cranes per ship and lower trolley travel speeds.

The crane according to the invention results in less loading on the runway as the weight of the crane is practically divided in half on each quay and requires no counterweight. This results in a reduction of cost of foundation works and in superior behaviour of the structure in locations subjected to earthquake.

The crane according to the invention offers superior aerodynamic performance permitting operations under higher wind speeds, notably due to superior geometry of the girders and legs.

The invention also has superior performance in heavy lift, as trolleys may be operated in tandems, up to four trolleys if two adjacent cranes are used.

The invention offers an easier control of sway due to shorter hoist ropes and reduced acceleration/braking compared with conventional STS cranes.

The trolleys preferably travel only half the width of the ship which allows to reduce the trolley speed without any loss of productivity in comparison with conventional STS cranes. This results in reduction in maintenance costs and in noise level during operation. Additional reduction in noise is a result of absence of a boom-to-bridge girder rail joint, unavoidable on conventional STS cranes.

The trolleys are preferably self-propelled.

All the trolleys of the crane notably travel at the same level.

The spacing between the girders may be based on row spacing in ULCV, and may be fixed between 26 and 30 m (measured from centre to centre); so that trolleys traveling on different girders can at the same time each carry a container from the quay to the vessel or vice versa.

Preferably, each hoist is laterally movable, notably both ways, relative to centreline of the corresponding girder. In this way, the crane can equalize differences in container row spacings, by allowing a move of the hooks in longitudinal direction of the vessel. The amplitude of lateral move of a hoist relative to the girder may be at least 0.5 m, preferably 1 m, each way and on each trolley.

The legs are preferably of box-section so that they can accommodate an elevator and stairs up to the girders.

The girders are preferably rigidly connected to one leg and pinned to the other leg.

Both legs and girders are designed to offer superior aerodynamic shape factors.

The legs are preferably not telescopic.

The girders preferably have a fixed height. In other words, the height of the girders is preferably not adjustable.

The crane preferably comprises two legs only. The crane preferably comprises two girders only. The crane may comprise four trolleys only.

The crane preferably comprises cantilevers extending beyond a main span. It is of advantage that the girders be suspended in a way to allow the trolleys to pass on to cantilevers. This may facilitate handling of containers on the quays.

Preferably, the girders are interconnected by horizontal bracing.

The girders are preferably of variable depth. They are preferably pre-stressed to reduce their mass and improve their fatigue performance. The trolleys advantageously travel on tracks situated below the top edge of the girders. This reduces the length of the hoist ropes.

The crane preferably comprises suspension cross beams connected to respective legs and carrying the girders. These cross beams are preferably prestressed to reduce their mass and improve their fatigue life.

The girders preferably comprise lateral extensions or brackets carrying tracks on which the trolleys travel.

According to a further aspect, the invention relates to a container terminal comprising:

A double-sided berth, preferably an indented berth,

At least one portal gantry crane according to the invention, spanning across the berth.

Preferably, the gantry crane travels on tracks extending along each side of the berth.

The container terminal advantageously comprises a plurality of portal gantry cranes according to the invention traveling along said tracks, preferably three to four cranes.

A further aspect of the invention relates to a method for loading/unloading a container vessel received in a double-sided berth of the container terminal according to the invention, as defined above, comprising:

Moving the trolleys along the girders so that each trolley moves between a first position substantially median to the vessel and a second position on a corresponding side of the vessel.

Each trolley can be operated independently.

For heavy lift operations, two portal gantry cranes can be positioned adjacent to each other, four adjacent trolleys of said cranes being operated simultaneously as a unit. Another possibility is to operate two trolleys on one girder in tandem.

The method may comprise displacing laterally the hoist relative to the centre of the trolley that carries it to adjust to the position of containers in the vessel.

Figure 1:
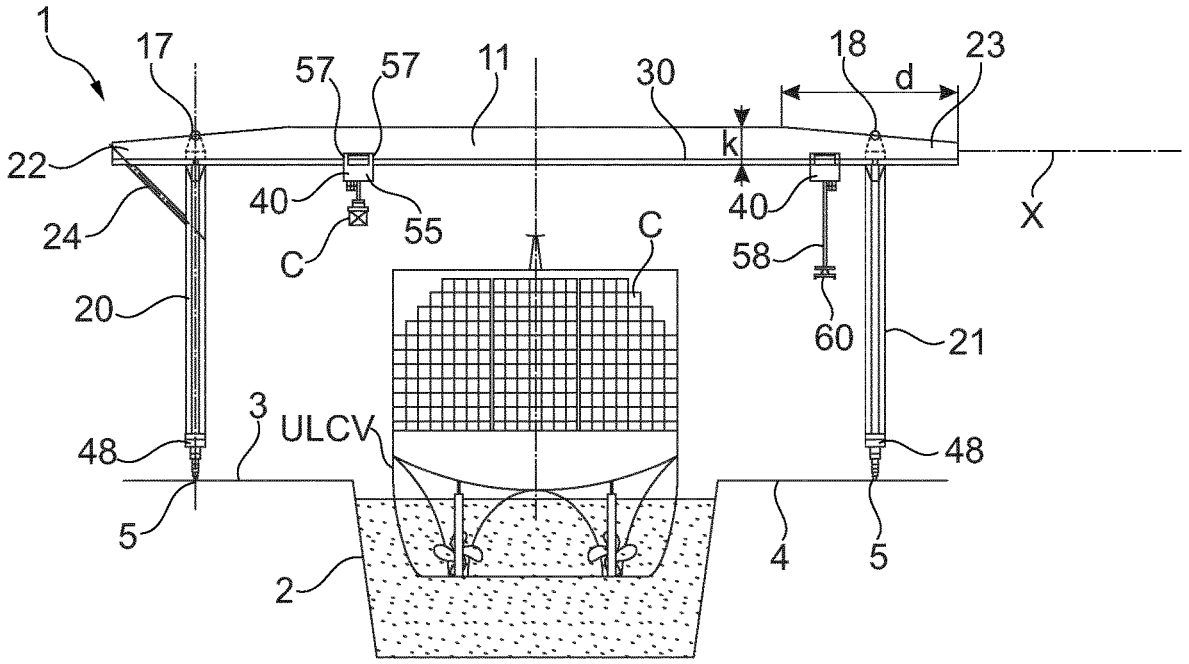
Figure 3:
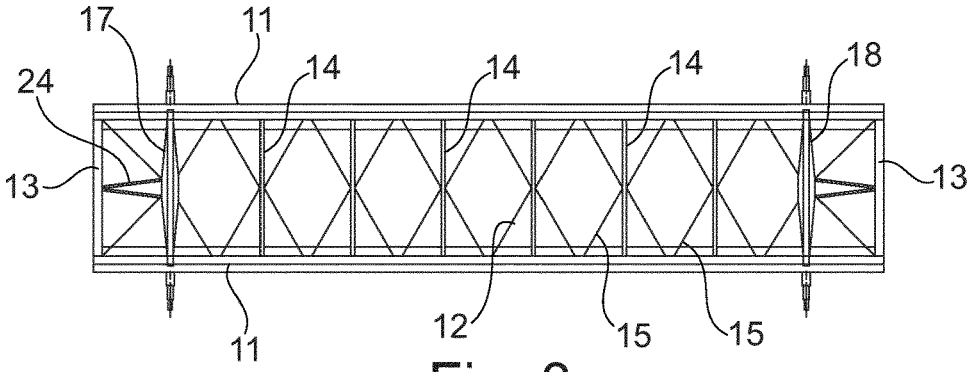
Figure 4:
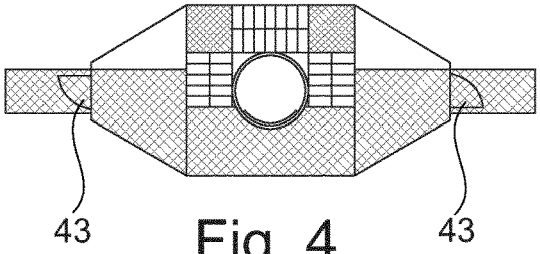
Figure 5:
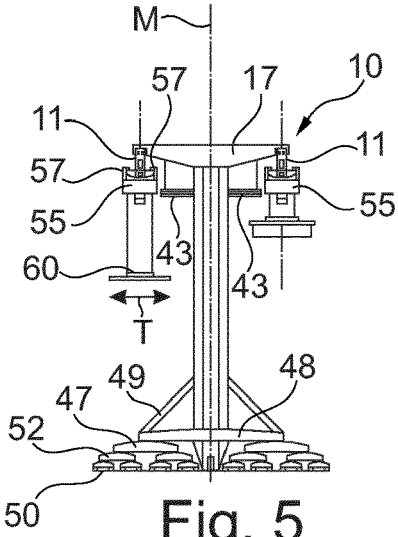
Figure 6:
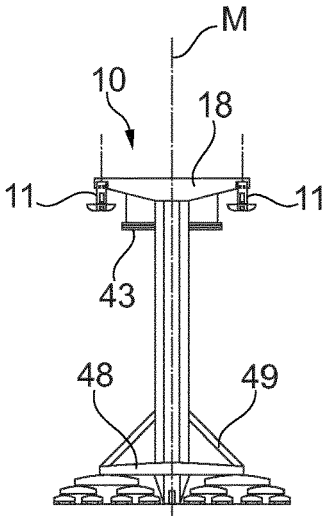
Figure 10:
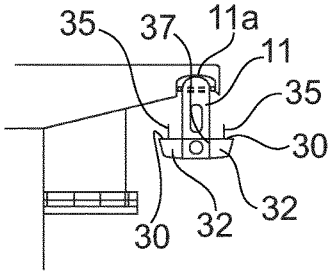
Figure 11:
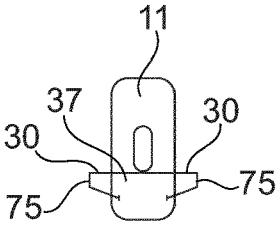
Figure 7:
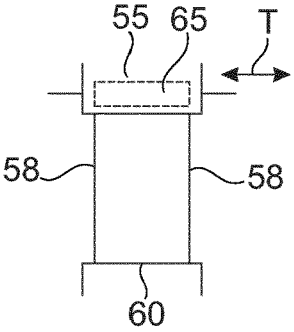
Figure 8:
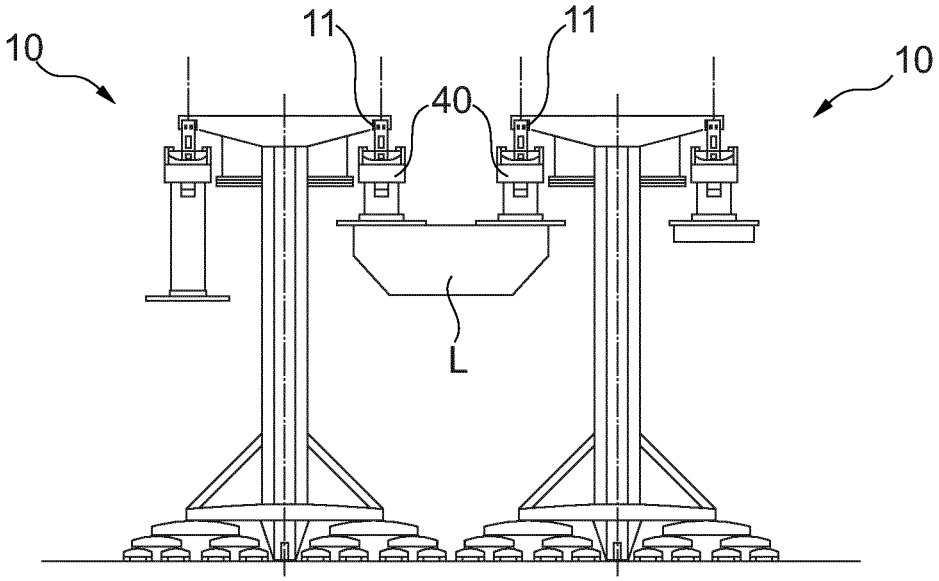
Figure 9:
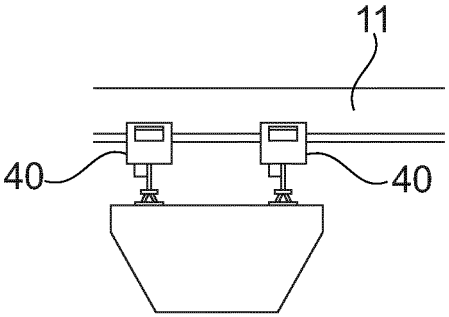

Exemplary embodiments of the present invention will now be described in reference to the attached drawings, on which:

FIG. 1 is a schematic cross-section of a container terminal according to the present invention, FIG. 2 is an elevation of the portal gantry crane of FIG. 1, FIG. 3 is a top view of the crane of FIG. 2, FIG. 4 is a section along IV-IV of FIG. 2, FIG. 5 is a section along V-V of FIG. 2, with trolleys made apparent, FIG. 6 is a cross-section along VI-VI of FIG. 2, with trolleys made apparent, FIG. 7 illustrates the lateral displacement of the hoist of a trolley, FIG. 8 illustrates the operation in tandem of trolleys belonging to adjacent cranes, FIG. 9 illustrates the operation in tandem of trolley traveling along a same girder, FIG. 10 shows in cross-section a girder, FIG. 11 is a view similar to FIG. 10 of a variant embodiment.

FIG. 1 shows a container terminal 1 according to the present invention. This terminal 1 comprises an indented berth 2 extending between opposite left 3 and right 4 quays. The berth 2 is preferably configured for receiving an Ultra Large Container Vessels ULCV as illustrated. Such a vessel carries typically more than 13 000 TEU.

The berth 2 may include roadways and/or railways and various facilities (not shown) for transportation and storage of containers unloaded from the vessels or waiting to be loaded.

Two tracks 5 extend along the berth 2 on each side thereof for travel of at least one portal gantry crane 10 made in accordance to the present invention. Preferably, more than one crane 10 is present on the tracks 5. Up to four cranes 10 may be present.

Each crane 10 comprises, as can be seen on FIG. 3, two parallel horizontal main girders 11. The two parallel horizontal main girders 11 are connected together by a bracing 12, which may include as shown end beams 13, transverse intermediate beams 14 of smaller section than end beams 13 and oblique beams 15 of smaller section than intermediate beams 14.

The bracing 12 preferably follows the upper line of the girders. The beams 14 and 15 are preferably of tubular design for better aerodynamics. The bracing 12 improves the stability and aerodynamic performance of the girders 11.

The girders 11 are suspended from suspension beams 17 and 18 that are supported respectively by a fixed leg 20 and a shear leg 21.

The girders 11 are preferably prestressed to reduce their mass and improve their fatigue life.

The girders 11 are positioned symmetrically with respect to a midplane M.

The crane 10 comprises cantilevers 22 and 23 extending beyond the main span.

A twin brace 24 connects the fixed leg 20 to the cantilever 22 to stabilize the structure in direction of trolley travel.

Each girder 11 defines, as can be seen on FIGS. 1 and 10, tracks 30 for a couple of trolleys 40.

The tracks 30 extend on lateral extensions 32 at the lower part of the girder 11.

The tracks 30 are horizontal. They support the mass of the trolley and of the load.

Each lateral extension 32 carries a handrail 35.

The body 37 of the girder 11 extends between the tracks 30.

The horizontal tracks 30 extend at a non-zero distance h from the top edge 11*a* of the girders 11.

The girders 11 exhibit a constant depth k along a major portion of their length and preferably their depth starts decreasing down to their ends at a distance d from their ends.

The legs 20, 21 are of box section as shown in FIG. 4 and house an elevator shaft and stairwell around the elevator shaft, up to a walkway 43 giving access to the trolleys.

The legs 20, 21 are preferably connected to base support beams 48, struts 49 being integral part of this connection. The base support beams 48 rest via equalizers 47, 52 on bogies 50 traveling on the quay tracks 5.

Each trolley 40 is self-propelled and comprises a machinery house 55 with the hoist mechanism. The drive mechanism is located above the track.

Machinery house 55 is suspended below the girder 11 by two frames 57 that hold the wheels that engage the tracks 30.

The ropes 58 of the hoist carry a spreader 60 configured for attachment to a container C.

Preferably, as shown in FIG. 7, the hoist with ropes 58 is capable of transverse movement in a direction T under the machinery house 55 thanks to a side shift mechanism 65. Such mechanism may comprise a truck movable in a transverse direction, perpendicularly to a longitudinal axis X of the girder 11, this truck carrying the hoist.

The amplitude of transverse movement of the hoist is for example of at least 0.5 m each way.

The presence of two girders 11 and a pair of trolleys 40 on each girder 11 allows fast loading and fast unloading from both sides of the vessel and enables a step change in overall performance by transferring large numbers of containers to and from the largest vessels while removing the vessel beam width restrictions of conventional STS cranes.

The invention enables to more than double loading/unloading productivity when compared to best current systems; moreover, the efficiency/productivity increases with increase in the ship size.

The crane 10 can also be operated in heavy lift operations.

The two trolleys 40 of a same girder 11 may be operated in tandem as illustrated in FIG. 9, doubling the hoisting capacity.

In the variant embodiment illustrated in FIG. 8, two cranes 10 are positioned one next to the other and the trolleys 40 of the adjacent girders 11 are operated in tandem to carry a common load L, which results in fourfold hoisting capacity compared to a single trolley.

Secondary structures of the crane, such as handrails or sheeting of machinery houses, are preferably made of composite materials to contribute to reduction of weight of the crane and improve resistance to corrosion. This sheeting is preferably made of a translucent material to save energy.

The present invention is not limited to the disclosed embodiments. For example, various modifications may be brought to the shape of the girders 11.

FIG. 11 shows a variant embodiment in which the tracks 30 on which the trolleys travel are defined by brackets 75 that extends on both sides of the girder main body 37.

Trolleys 40 may be tele-operated from a remote control room. In a variant, cabin suspended from the machinery house 55 of the trolley 40 is configured for accommodating a crane driver. One trolley 40 may be a master trolley controlling the overall crane travel.

The system is preferably fully automatic.

The invention claimed is:

1. Portal gantry crane for loading/unloading containers from a container vessel comprising:

two parallel main girders running side by side on respective sides of a midplane, two legs each crossed by said midplane, two couples of trolleys, each couple of trolleys operating on a corresponding girder, each trolley carrying a hoist, ropes of which carrying a spreader configured for attachment to a container, each hoist being laterally movable both ways relative to a centreline of the corresponding girder, and suspension cross beams connected to respective legs and carrying the girders.

2. Portal gantry crane according to claim 1, the legs being of box-section.

3. Portal gantry crane according to claim 1, the girders being rigidly connected to one leg and being pinned to the other leg.

4. Portal gantry crane according to claim 1, comprising cantilevers extending beyond a main span, the girders being suspended in a way to allow the trolleys to pass on to cantilevers.

5. Portal gantry crane according to claim 1, the girders being interconnected by horizontal bracing.

6. Portal gantry crane according to claim 1, the girders being of variable depth, the trolleys traveling on tracks situated below a top edge of the girders.

7. Portal gantry crane according to claim 1, the girders comprising lateral extensions or brackets carrying tracks on which the trolleys travel.

8. Portal gantry crane according to claim 1, the trolleys being self-propelled.

9. Portal gantry crane according to claim 1, wherein the main girders are prestressed.

10. Container terminal comprising:

a double-sided berth, at least one portal gantry crane according to claim 1, spanning in a transverse direction across the berth.

11. The terminal of claim 10, the gantry crane traveling on tracks extending along each side of the berth.

12. The terminal of claim 11, comprising a plurality of portal gantry cranes traveling along said tracks.

13. The terminal of claim 12 the plurality being three to four cranes.

14. The terminal of claim 10, the berth being an indented berth.

15. A method for loading/unloading a container vessel received in the double-sided berth of the container terminal of claim 10, comprising:

moving the trolleys along the girders so that each trolley moves between a first position substantially median to the vessel and a second position on a corresponding side of the vessel.

16. The method of claim 15, two portal gantry cranes being positioned adjacent to each other, four adjacent trolleys of said cranes being operated simultaneously as a unit in heavy lift operations.

17. Portal gantry crane according to claim 1, wherein the suspension cross beams are prestressed.

* * * * *